US006276968B1

(12) United States Patent
Belopolsky

(10) Patent No.: US 6,276,968 B1
(45) Date of Patent: Aug. 21, 2001

(54) ELECTRICAL CONNECTOR WITH COMPONENT PACKAGE

(75) Inventor: Yakov Belopolsky, Harrisburg, PA (US)

(73) Assignee: BERG Technology, Inc., Reno, NV (US)

( * ) Notice: Subject to any disclaimer, the term of this patent is extended or adjusted under 35 U.S.C. 154(b) by 0 days.

(21) Appl. No.: 09/360,205

(22) Filed: Jul. 23, 1999

(51) Int. Cl.[7] ..... H01R 13/66; H01R 33/965
(52) U.S. Cl. ..... 439/620; 439/941
(58) Field of Search ..... 439/620, 607, 439/676, 941

(56) References Cited

U.S. PATENT DOCUMENTS

| | | | | |
|---|---|---|---|---|
| 0,886,365 | | 5/1997 | Belopolsky et al. . | |
| 5,069,641 | | 12/1991 | Sakamoto et al. | 439/620 |
| 5,403,207 | | 4/1995 | Briones | 439/620 |
| 5,456,619 | | 10/1995 | Belopolsky et al. | 439/620 |
| 5,587,884 | | 12/1996 | Raman | 361/728 |
| 6,022,245 | * | 2/2000 | Minich | 439/620 |

OTHER PUBLICATIONS

U.S. application No. 08/863,654, Belopolsky et al., filed May 27, 1997.*

* cited by examiner

*Primary Examiner*—Gary Paumen
*Assistant Examiner*—Alexander Gilman
(74) *Attorney, Agent, or Firm*—Woodcock Washburn Kurtz Mackiewicz & Norris LLP

(57) ABSTRACT

An electrical connector such as a modular jack receives a component package having a plurality of first conductive elements and at least one electrical device electrically coupled to the first conductive elements. The electrical connector has an insulative housing with an interior and an insulative insert with a forward portion and a rear portion. The rear portion defines a recess for receiving the component package therein, and the insert is mounted within the interior of the housing. A plurality of first contacts are mounted to the forward portion of the insert for electrically contacting conductors in a mating connector inserted into the electrical connector. Each first contact extends from the forward portion of the insert to the recess and terminates at a termination in communication with the recess. The termination of each first contact electrically contacts a corresponding first conductive element of the component package as received in the recess.

26 Claims, 11 Drawing Sheets

ELECTRICAL CONNECTOR WITH COMPONENT PACKAGE

FIELD OF THE INVENTION

The present invention relates to an electrical connector and more particularly to an electrical connector which can securely removably receive a component package.

BACKGROUND OF THE INVENTION

In electronic appliances containing modular jacks, various types of filter and signal conditioning devices are used to reduce or eliminate noise. Such filters may include a three terminal capacitor or a common mode choke coil. A disadvantage in the use of such filters is that they may complicate the production of the circuit board. A need, therefore, has been perceived for providing a simple means of filtering noise in modular jacks.

The use of an integral ferrite element for this purpose is proposed in Japanese Patent Publication 64-2273. This reference discloses a modular jack having a modular insert installed in a casing. The body of the insert is formed with ferrite, and on one side of the insert body insert holes are formed for introducing connecting lines to be connected to respective contact springs.

While this reference would appear to simplify the apparatus used for noise filtering in modular jacks, a need for further increasing the compactness of such modular jacks with integral ferrite elements exists.

U.S. Pat. No. 5,456,619 discloses a filtered modular jack assembly having an outer insulative housing with open front and rear sides. A ferrite element with vertical conductive wires is positioned adjacent the rear end, and an elongated insulative insert is superimposed over the ferrite element. The insulative insert is fixed to the housing, and the conductive wire extends vertically from the ferrite element over the upper side of the insert to its terminal end and then bends downwardly and rearwardly to rest on the top surface of an interior medial wall in the housing. While this reference discloses an invention which increases compactness, a need still exists for a jack which can achieve such compactness while using alternate types of filtering elements which are not adapted to be mounted in the same way as the ferrite element.

U.S. patent application Ser. No. 08/863,654, hereby incorporated by reference, discloses a filtered modular jack assembly. The filter, preferably a common mode choke, sits within a cap that enters the rear open end of the insulative housing. The cap and the insulative insert form a cavity for the filter.

A need also exists for such a jack that can securely removably receive any of a plurality of filter elements or the like as mounted within a component package, especially in the field. Accordingly, if in the field or elsewhere it is determined that one filter element or the like (or any other suitable electric device for that matter) is not desired, the component package there-having may simply be removed from the jack, and be replaced by another component package having a more suitable filter element or the like (or any other suitable electric device for that matter).

SUMMARY OF THE INVENTION

In the present invention, an electrical connector such as a modular jack receives a component package having a plurality of first conductive elements and at least one electrical device electrically coupled to the first conductive elements.

The electrical connector has an insulative housing with an interior and an insulative insert with a forward portion and a rear portion. The rear portion defines a recess for receiving the component package therein, and the insert is mounted within the interior of the housing. A plurality of first contacts are mounted to the forward portion of the insert for electrically contacting conductors in a mating connector inserted into the electrical connector. Each first contact extends from the forward portion of the insert to the recess and terminates at a termination in communication with the recess. The termination of each first contact electrically contacts a corresponding first conductive element of the component package as received in the recess.

BRIEF DESCRIPTION OF THE DRAWINGS

The filtered electrical connector/modular jack assembly of the present invention is further described with reference to the accompanying drawings in which.

DETAILED DESCRIPTION OF PREFERRED EMBODIMENTS

Figure 1:
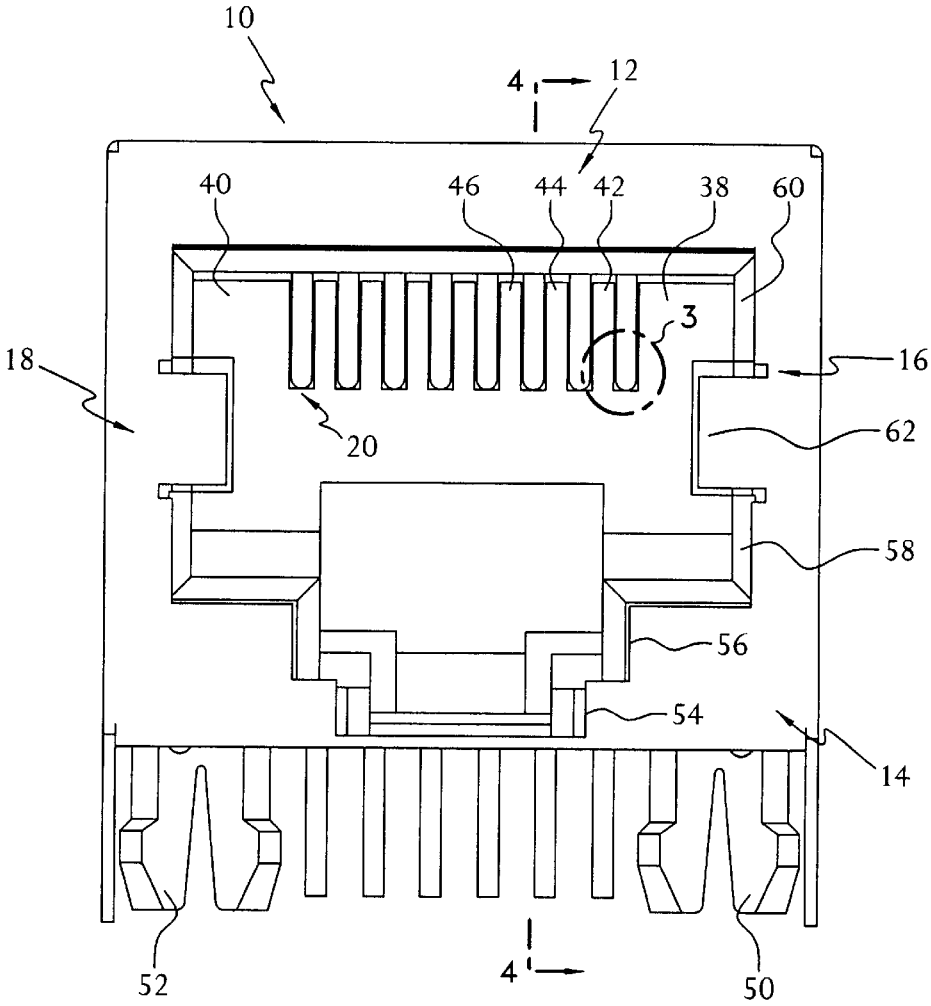
FIG. 1 is a front elevational view of one type of modular jack.
Figure 3:
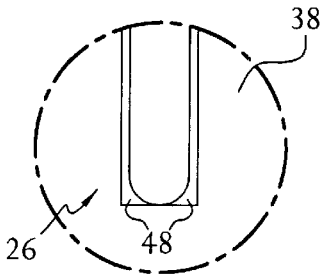
FIG. 3 is a detailed view of the area within circle 3 in FIG. 1.

Referring now to FIGS. 1–16*b*, wherein like numerals are used to indicate like elements throughout, one type of modular jack is shown for purposes of disclosing typical features in modular jacks. As will be seen in FIGS. 17–19, wherein like numerals are also used to indicate like elements throughout, the modular jack of the present invention shares many common features with the modular jack shown in FIGS. 1–16*b*.

As seen in FIGS. 1–10, the outer insulative housing is shown generally at numeral 10. This housing includes a top wall 12, a bottom wall 14 and a pair of opposed lateral walls 16 and 18. The housing could be constructed of a thermoplastic polymer having suitable insulative properties and may have conventional metallic exterior shielding. Within these walls is an interior section 20 which has a rear open end 22 and a forward open end 24. Projecting upwardly from the bottom wall in this interior section there is a medial wall generally shown at numeral 26 which has a rear side 28 and a front side shown generally at numeral 30 which includes a bottom front side 31, a top front side 32, a recessed medial front side 34, and an inclined top side 36 which slopes upwardly and forwardly from its rear side toward its front side. Adjacent to the lateral walls, the medial wall has lateral extensions 38 and 40 which serve as projections to retain other elements as will be hereafter explained, between these lateral extensions there are a plurality of wire separation extensions as at 42, 44 and 46 and between these wire separation extensions there arc plurality of slots as at 48.

As will be appreciated by those skilled in the art and is further explained hereafter, the wall and recesses of the outer insulative housing interact to receive an insert so as to make electrical connection between the conductors in the housing and the insert.

Extending downwardly from the bottom wall there are alignment and retention posts 50 and 52. The lateral wall 16 includes a lower shoulder 54, another shoulder 56, a lower main wall 58, an upper main wall 60 and a recessed wall 62 interposed between the lower and upper main wall. It will be seen that the lateral wall 18 has substantially identical features as lateral wall 16. The top wall 12 includes an upper bridge section 64, a lower bridge section 66, a front recess 68 and a rear recess 70.

Figure 4:
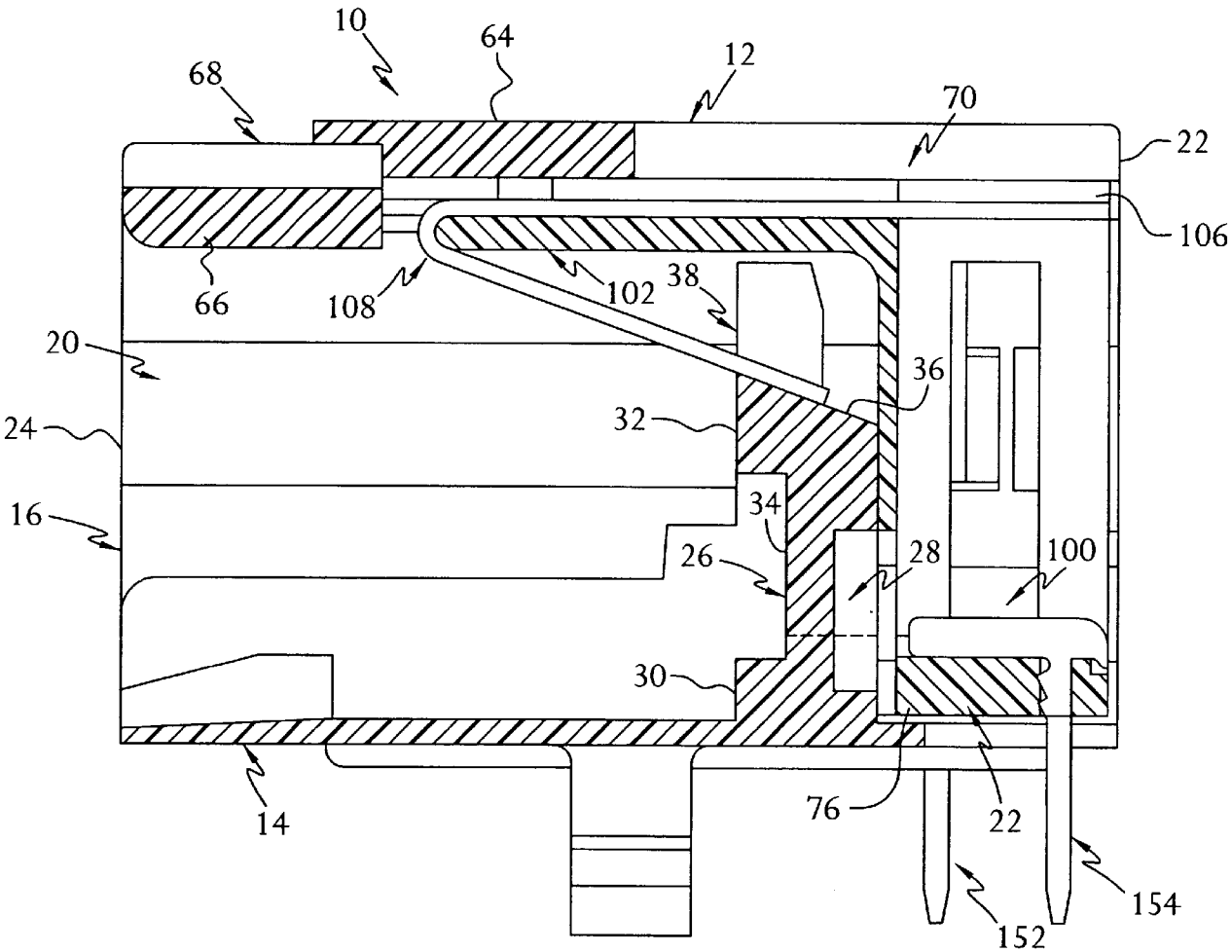
FIG. 4 is a cross sectional view through 4—4 in FIG. 1 in which for the purpose of showing other detail, shielding, the filter, and associated wires and the rear cap have been deleted.
Figure 5:
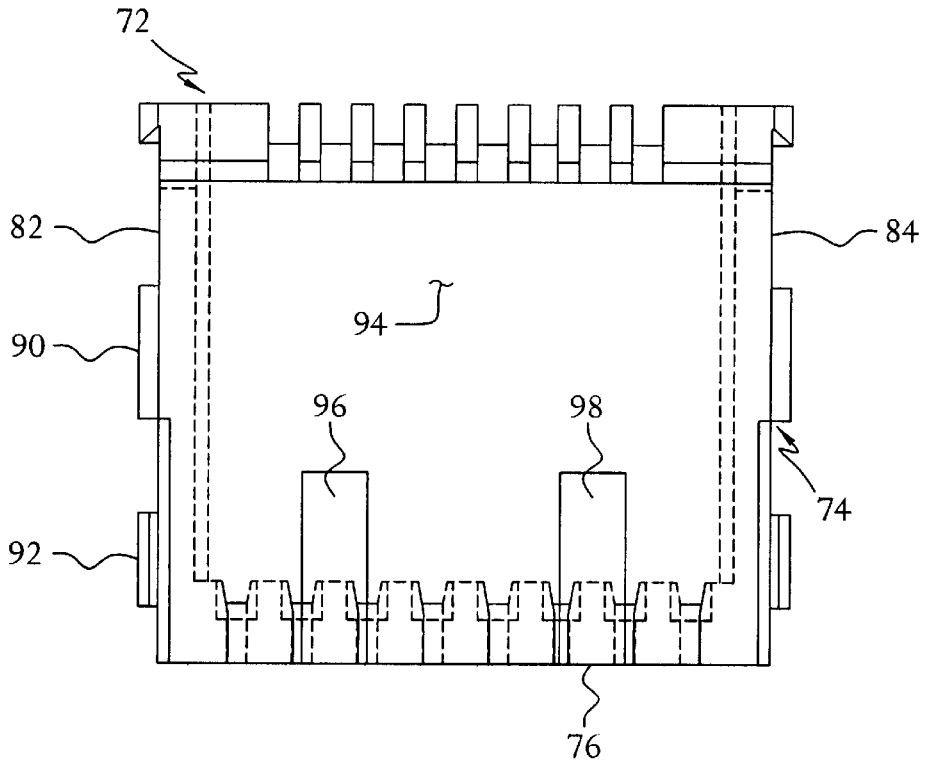
FIG. 5 is a front elevational view of the insulative insert used in the modular jack shown in FIG. 1.
Figure 7:
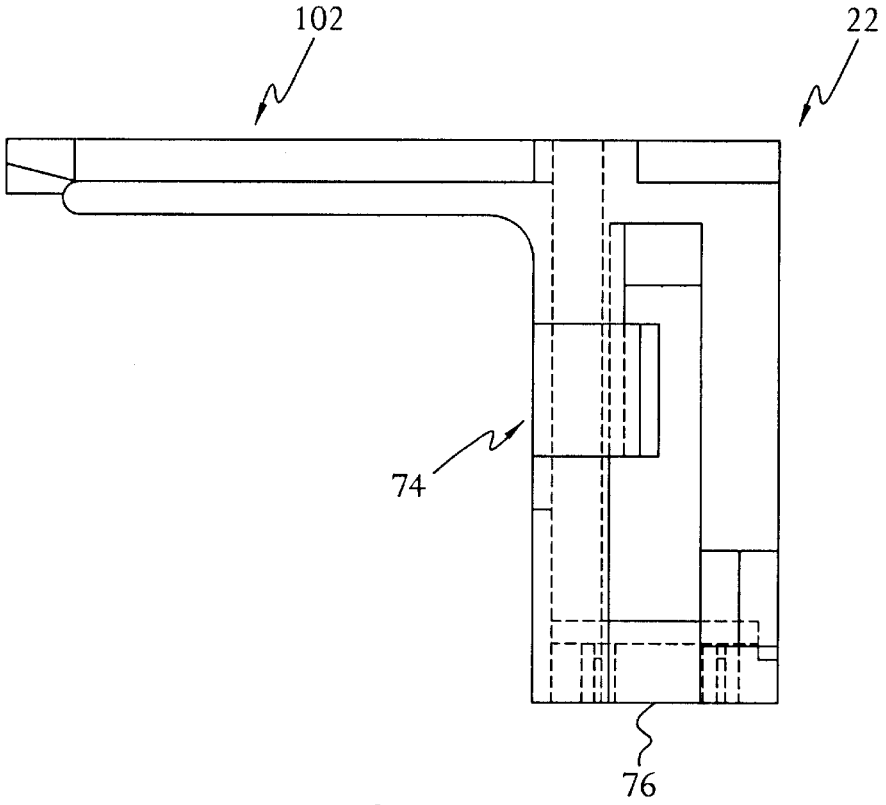
FIG. 7 is side elevational view of the insulative insert shown in FIG. 5.
Figure 8:
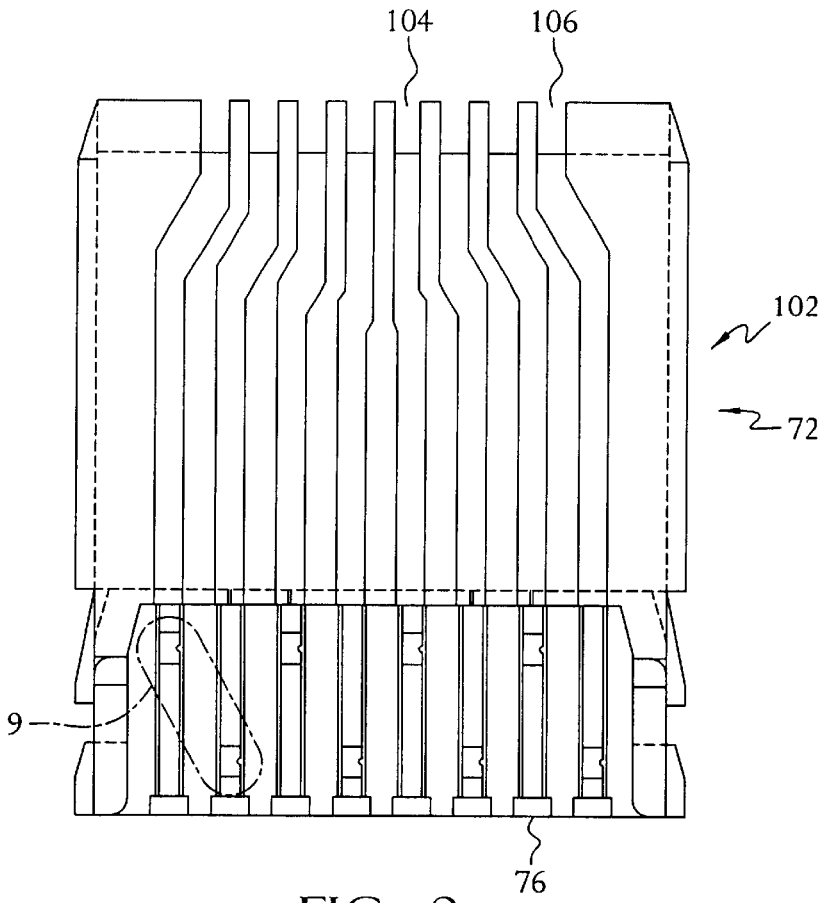
FIG. 8 is a top plan view of the insulative insert shown in FIG. 5.
Figure 6:
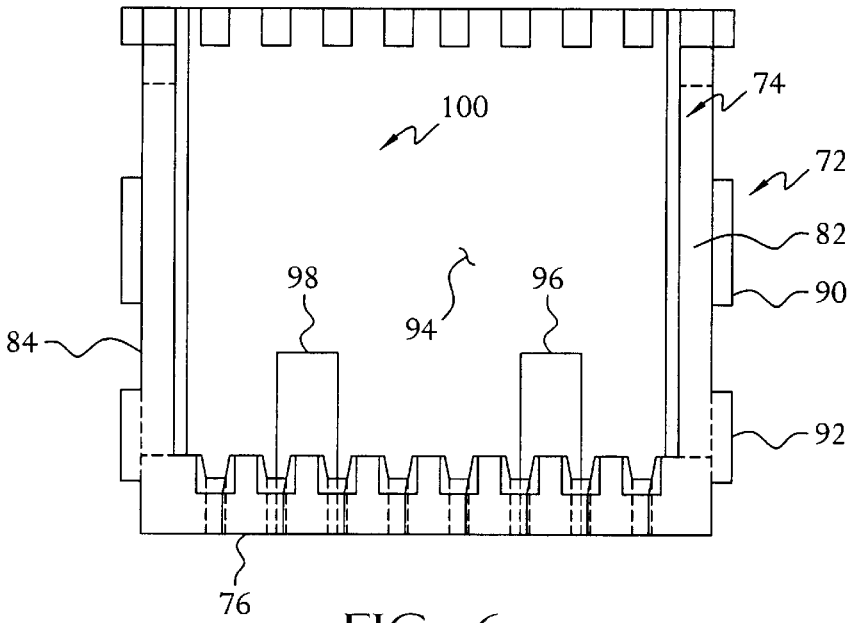
FIG. 6 is a rear elevational view of the insulative insert shown in FIG. 5.
Figure 9:
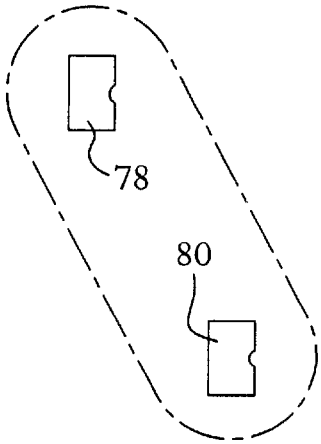
FIG. 9 is a detailed view of area 9 in FIG. 8.
Figure 10:
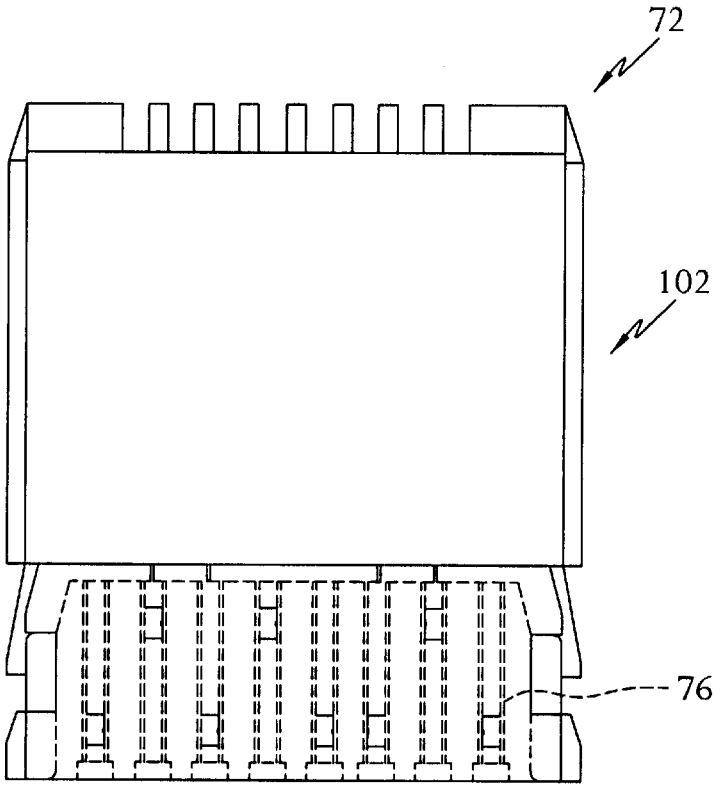
FIG. 10 is a bottom plan view of the insulative insert shown in FIG. 5.
Figure 12:
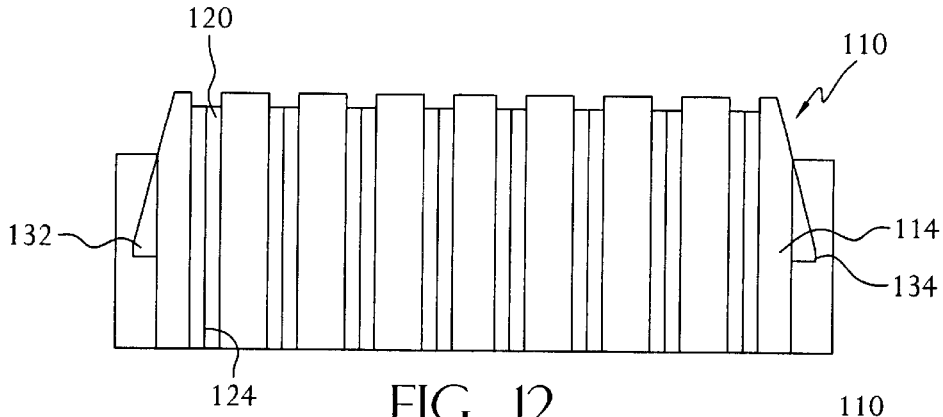
FIG. 12 is a top plan view of the cap shown in FIG. 11.
Figure 11:
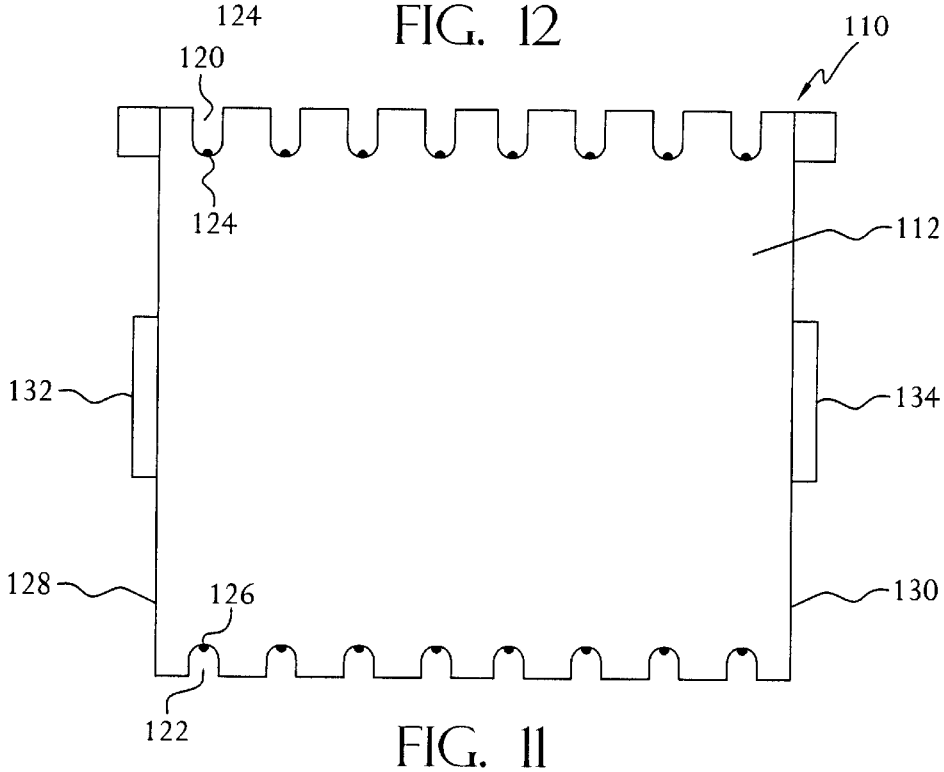
FIG. 11 is a rear end view of the cap element used in the modular jack shown in FIG. 1.
Figure 13:
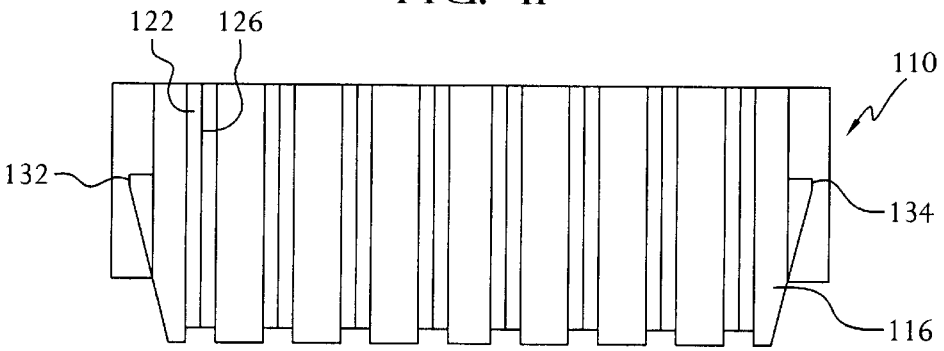
FIG. 13 is a bottom plan view of the cap shown in FIG. 11.
Figure 15:
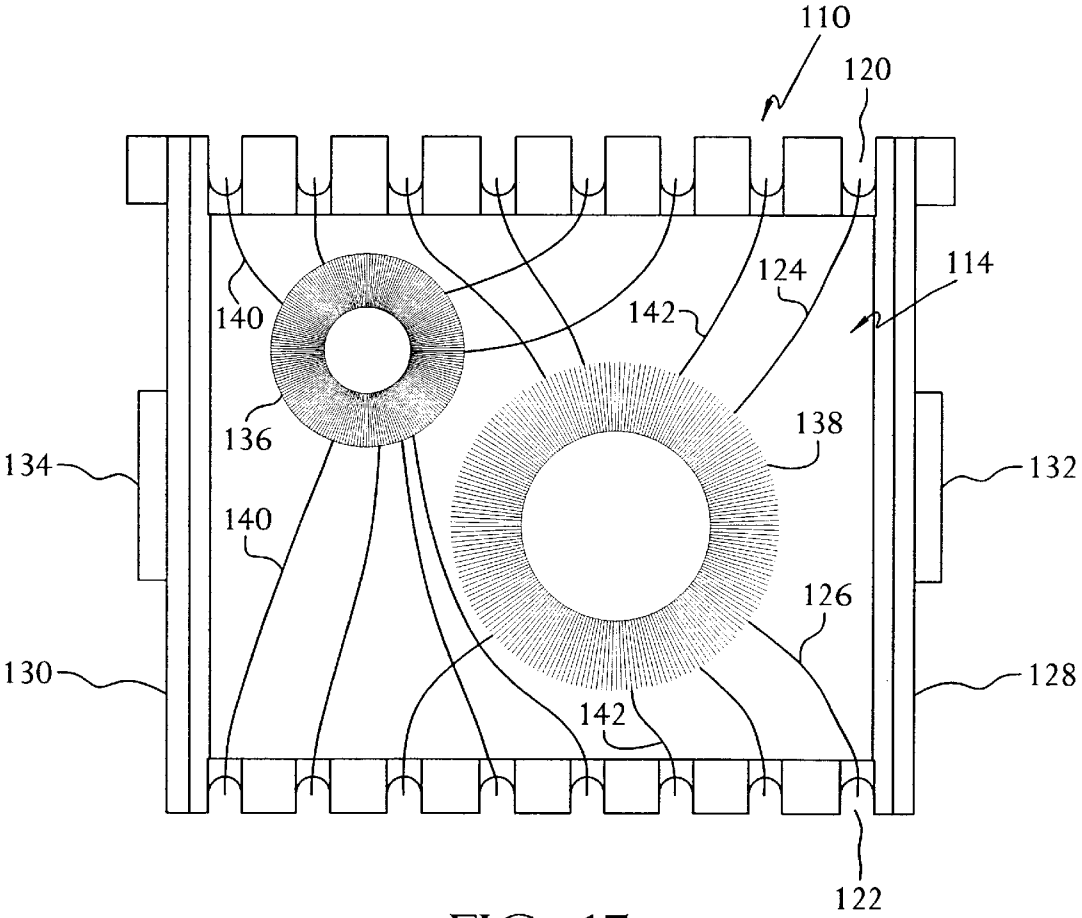
FIG. 15 is a interior view of the cap shown in FIG. 11.
Figure 14:
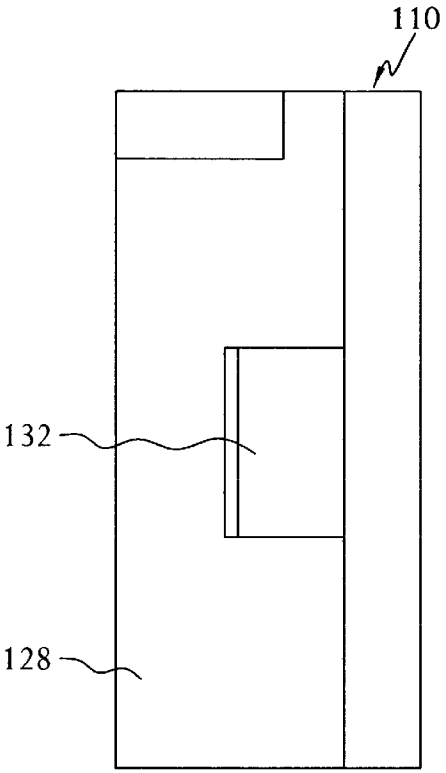
FIG. 14 is a side elevational view of the cap shown in FIG. 11.

Referring particularly to FIGS. 5–10, the insulative insert is shown generally at numeral 72. This insert has a vertical section shown generally at numeral 74 which includes a base wall 76. The base wall has a plurality of vertical bores as at 78 and 80. The vertical section also includes opposed side walls 82 and 84. Side wall 82 has a pair of latches 86 and 88. Side wall 84 has a pair of latches 90 and 92. The vertical section also has a front wall 94 in which there are apertures 96 and 98. Finally the vertical section 74 of the insert 92 has a recess 100. The insert also has a horizontal section shown generally at numeral 102 which has a plurality of grooves as at groove 104 and 106 which extend from the rear to the front of this horizontal section. In these grooves there are conductors as at wire 108 (FIG. 4).

Figure 2:
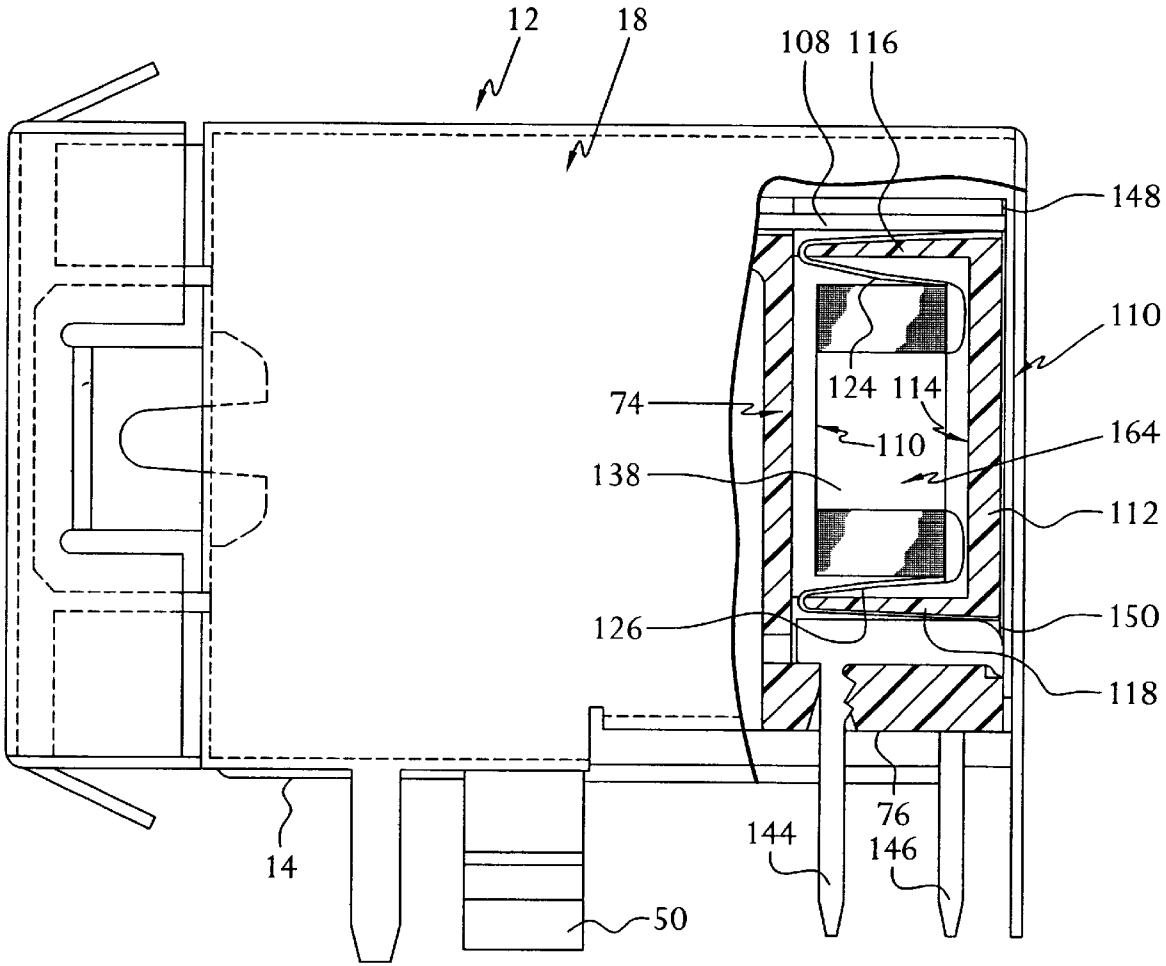
FIG. 2 is a cut away side elevational view of the modular jack shown in FIG. 1.

Referring particularly to FIGS. 2 and 11–15, the cap element is shown generally at numeral 110. This cap element has a rear wall 112 and on the reverse side of this wall there is a recess 114. The cap also has a top end wall 116 and a bottom end wall 118 which have respectively grooves as at groove 120 and 122. Conductors as at wire 124 and 126 are positioned in each of these grooves. The cap also has side walls 128 and 130 which have respectively latches 132 and 134 for engaging the side walls 82 and 84 of the insulative insert. A filter means such as common mode chokes 136 and 138 are mounted on the inner or recess side of the wall 112. Other filtering elements and signal conditioning elements known to those skilled in the art such as inductive serial filters, differential filters, low pass capacitive filters and other magnetic filters may be substituted for the common mode choke. Conductors as at wire 140 extend from the top wall to the common mode choke 136 and then to the bottom wall. Wires as at 142 extend from the top wall to the common mode choke 138 and then to the bottom wall. These wires are wound around the common mode chokes and serve to retain the common mode chokes in their positions. Referring particularly to FIG. 2, it will be appreciated that the wires that extend upwardly from the common mode chokes such as wire 124 are connected to the wires mounted in the insert such as wire 108. That is as wire 124 extends along the outside of wall 118 it abuts wire 108. It will also be appreciated that the wires that extend downwardly from the common mode chokes such as wire 126 are connected to contacts such as contacts 144 and 146. That is, for example, as wire 126 extends along the outside of wall 118 it abuts contact 144. Another wire (not shown) abuts contact 146 in a similar way. At the ends of wires 124 and 126 there is an ultrasonic weld 148 and 150, respectively, to secure wires 124, 126 to cap 110. Referring particularly to FIG. 4, it will be seen that contacts 152 and 154 are positioned to extend from the base wall 76 of the insert vertical section 74. To better show the recess 100 of the insert 22, the common mode chokes as at 136 and their connecting wires and the cap 110 are not shown. It will be understood, however, that wires from the common mode chokes are connected to the contacts 152 and 154 and to the insert wires as at wire 108 in the same way as is shown in FIG. 2.

Figure 16A:
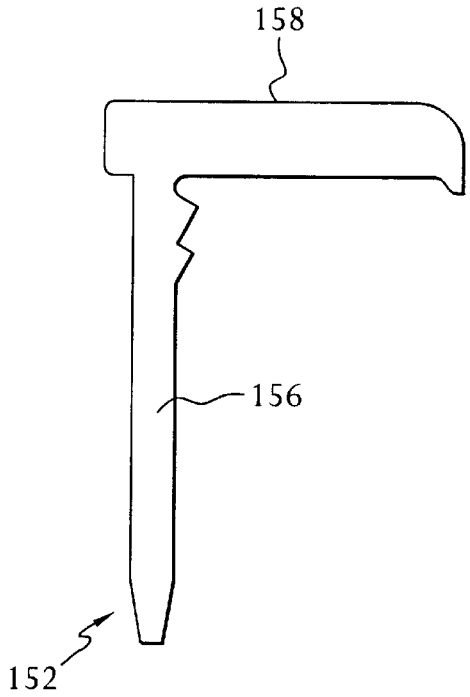
FIGS. 16*a* and 16*b* are side elevational views of two electrical contacts which are used in the modular jack shown in FIG. 1.
Figure 16B:
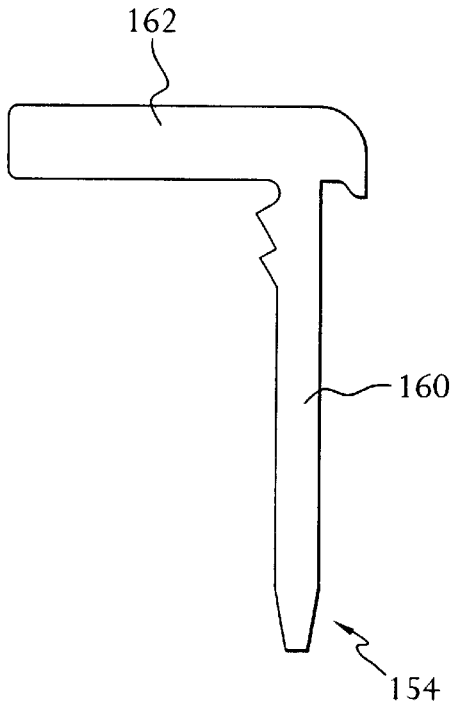

Referring particularly to FIG. 16*a*, it will be seen that contact 152 is comprised of a major vertical section 156 and a minor horizontal section 158. Referring particularly to FIG. 16*b*, it will be seen that contact 154 is comprised of a major vertical section 160 and a minor horizontal section 162 which is oriented in opposed relation to the horizontal section 158 of contact 152. Referring particularly to FIG. 2, it will be appreciated that the recess 100 and the cap element 110 together form an internal cavity 164 in the vertical section 74 of the insulative insert for containment of the common mode chokes.

It will be appreciated that a compact modular jack as shown in FIGS. 1–16*b* facilitates the use of several different types of filtering elements depending on specific needs. That is, a large variety of filters or other components may be housed in the recess of the insert. Consequently, the use of standard package as is required in many prior art modular jacks is not necessary so as to allow greater flexibility in meeting specific application needs. It will also be appreciated, however, that the filtering element or the like in the jack of FIGS. 1–16*b* is not normally removable once inserted. Accordingly, if in the field or elsewhere it is determined that one filter element or the like or other suitable electric device is not desired, such filter element or the like or other electric device cannot simply be removed from the jack and be replaced by another more suitable filter element or the like.

Figure 17:
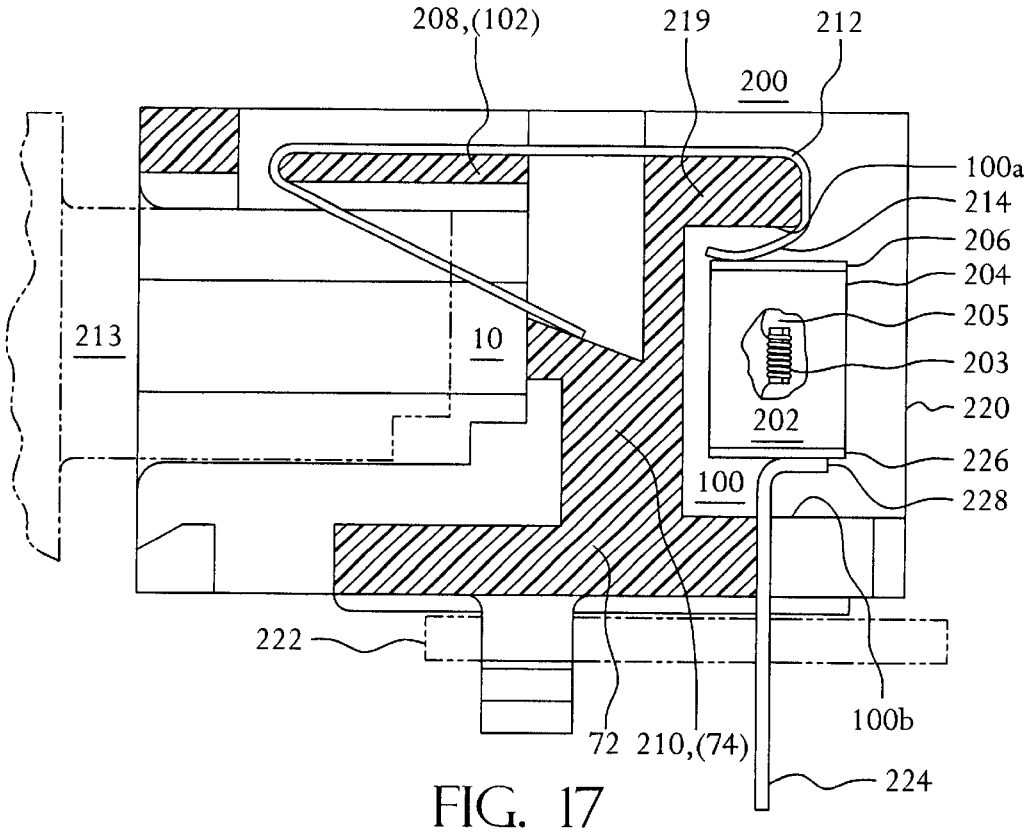
FIG. 17 is a cut away side elevational view of a modular jack in accordance with a first embodiment of the present invention.
Figure 18:
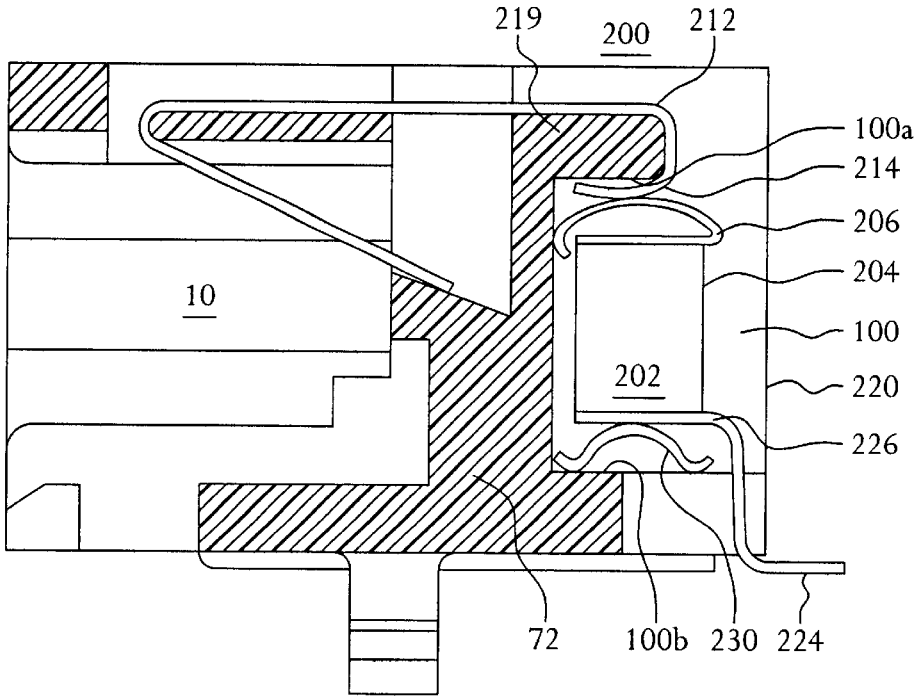
FIG. 18 is a cut away side elevational view of a modular jack in accordance with a second embodiment of the present invention.
Figure 19:
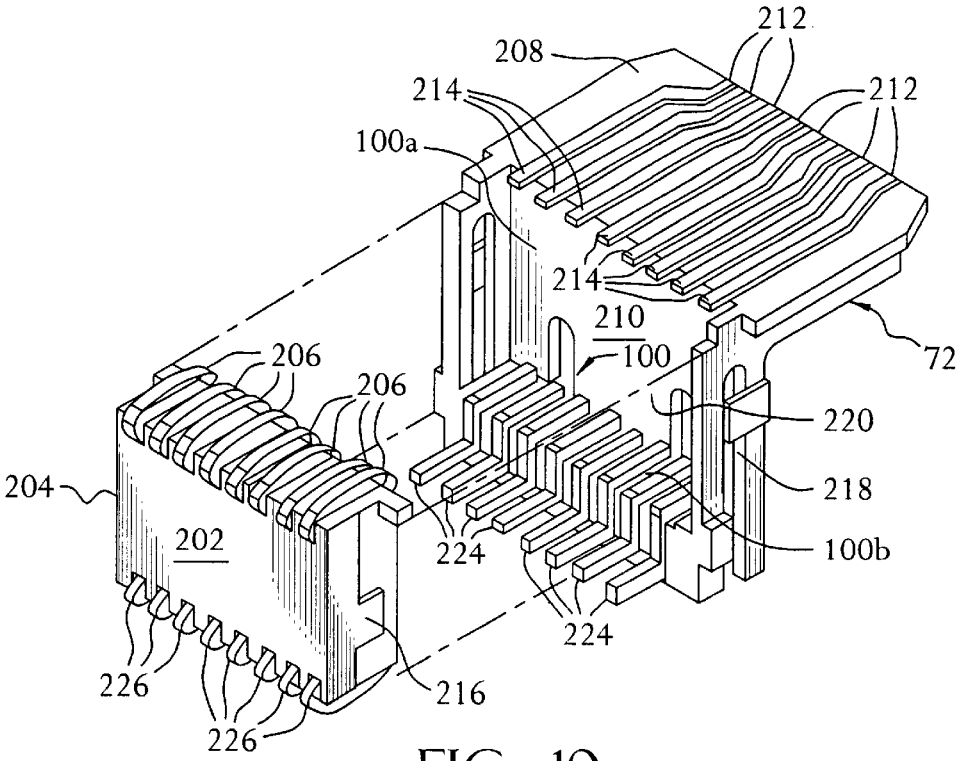
FIG. 19 is an exploded perspective view of a portion of a modular jack in accordance with a third embodiment of the present invention.

Referring now to FIGS. 17–19, it is seen that in contrast to the jack of FIGS. 1–16*b*, the jack 200 of the present invention accommodates a component package 202 having a suitable electric device, where the component package 202 is in fact removably insertable and therefore exchangeable in the field or elsewhere with other component packages 202 having other suitable electric devices. Thus, and as described above, if it is determined that one electric device is not desired, the component package there-having may simply be removed from the jack, and be replaced by another component package having a more suitable electric device.

In particular, and referring now to FIG. 17, the modular jack 200 of the present invention is similar to the jack shown in FIGS. 1–16*b* in that such jack 200 has an insert 72 with walls that define a recess 100, where the insert 72 is mounted within an interior section of an insulating housing 10. Here, the recess 100 securely removably receives the component package 202 having an electrical or electronic device 203 therein.

As should be understood, the electrical device 203 may be the aforementioned filter, signal conditioning device, or the like or any other electrical device that may be received in the component package 202 such that the component package 202 may be received in the recess 100. For example, the electrical device 203 may be a resistor or capacitor, a simple electronic circuit, an antenna, a complex integrated circuit, etc.

As seen in FIGS. 17 and/or 17A, the component package 202 has an interior 205, an exterior surface 204, a plurality of first conductive elements 206 mounted on the exterior surface 204, and at least one electrical device 203 mounted in the interior 205 and electrically coupled to the first conductive elements 206. In one embodiment of the present invention, the component package 202 is formed as a multi-layer laminate with magnetics therein, whereby the magnetics are formed as part of the process of forming the package 202 as a multi-layer laminate. Methods and systems for forming multi-layer magnetic laminate packages are known and therefore need not be discussed further herein.

In terms of the present invention, the insert 72 as shown in FIGS. 1–16*b* may be defined to include a forward portion 208 (i.e., the horizontal section 102, generally) and a rear portion 210 (i.e., the vertical section 74, generally), where the rear portion 210 defines the recess 100 that receives the component package 202 therein. Again, the insert 72 is mounted within an interior section of the insulating housing 10.

As seen in FIGS. 17–19, a plurality of first contacts 212 are mounted to the forward portion 208 of the insert 72. As should be understood, such first contacts 212 are for electrically contacting conductors (not shown) in a mating connector 213 inserted toward the forward portion 208 of the insert and into the jack 200 (FIG. 17). Each first contact 212 extends from the forward portion 208 of the insert 72 to the recess 100 and terminates at a termination 214 that is in communication with the recess 100. Depending upon the configuration (FIGS. 17–19), 'in communication' may mean that each termination 214 resides within the area that could generally be described as the recess 100 (FIGS. 17, 18), or at an upper boundary of the recess 100 (FIG. 19). In any case, and as will be explained in more detail below, 'in communication' requires that the termination 214 of each first contact 212 electrically contact a corresponding first conductive element 206 on the exterior surface 204 of the component package 202 as received in the recess 100.

In one embodiment of the present invention, each termination 214 of the plurality of first contacts 212 is a spring termination. That is, each termination 214 is constructed from a suitable material such that the termination 214 can act as a spring if biased in a particular manner. Here, the spring terminations 214 may be biased toward the recess 100, whereby the terminations 214 of the plurality of first contacts 212 in combination releasably secure the component package 202 as received in the recess 100, as is shown in FIG. 17, for example.

As should be understood in connection with the jack 200 shown in FIG. 17, the package 202 may be inserted into the recess 100 of such jack 200 by slightly moving the terminations 214 of the first contacts 212 away from the recess, whereby enough vertical clearance is achieved to allow the package 202 to be moved fully into the recess 100. In the moved-in position, then, the terminations 214 act to force the package 202 toward the bottom of the recess 100 and at the same time securely releasably hold the package 202 within the recess 100.

In one embodiment of the present invention, and in a manner akin to that shown in FIG. 4, the first contacts 212 extend from the forward portion 208 of the insert 72 to the recess 100 generally in a first plane such that the first contacts 212 in combination form a first side 100*a* (not shown in FIG. 4) of the recess 100. The recess 100 thus defines a mouth 220 (shown in FIGS. 17, 18) thereof that generally resides in a second plane generally perpendicular to the first plane. As should now be understood, the rear portion 210 of the insert 72 defines a second side 100*b* (shown in FIGS. 17, 18) of the recess generally opposite the first side 100*a*, and the component package 202 as received in the recess 100 is releasably secured between the first and second sides 100*a*, 100*b* of the recess 202 after being inserted into the recess 202 through the mouth 220 thereof.

In another embodiment of the present invention, and as shown in FIGS. 17 and 18, the first contacts 212 extend from the forward portion 208 of the insert 72 to the recess 100 generally in the aforementioned first plane and then curve around a ledge 219, down and back to the respective terminations 214 such that the ledge 219 forms the first side 100*a* of the recess 100. Again, the component package 202 as received in the recess 100 is releasably secured between the first and second sides 100*a*, 100*b* of the recess 202 after being inserted into the recess 202 through the mouth 220 thereof.

Of course, other devices may be employed to securely releasably hold the package 202 within the recess 100. For example, and as seen in FIG. 19, the insert 72 and the exterior surface 204 of the package 202 may include appropriately arranged corresponding latches 216 and latch catches 218. Preferably, such latches 216 and latch catches 218 secure the package 202 with respect to the recess 100 and the first contacts 212 in an appropriate manner whereby each first contact 212 electrically contacts a corresponding first conductive element 206 on the exterior surface 204 of the component package 202 as received in the recess 100.

In still another embodiment of the present invention, and still referring to FIG. 19, it is seen that the first contacts 212 extend from the forward portion 208 of the insert 72 to the recess 100 generally in a first plane, wherein the recess defines a first open side 100*a* thereof that generally resides in the first plane. That is to say, and in contrast with the embodiment of the present invention shown in FIGS. 17 and 18, the first contacts 212 do not extend so far in the first plane and the insert 72 does not include a ledge 219. Thus, no first (closing) side 100*a* of the recess 100 is formed, as in FIGS. 17 and 18. Instead, the first side 100*a* of the recess 100 of FIG. 19 is an open first side 100*a*. The recess 100 of FIG. 19 does still define a mouth 220 thereof that generally resides in a second plane generally perpendicular to the first plane, and the rear portion 210 of the insert 72 does still define a second side 100*b* of the recess 100 generally opposite what is now the first open side 100*a*.

Accordingly, the component package 202 as received in the recess 100 of FIG. 19 is releasably secured between the first open side 100*a* and the second side 100*b*, but of course is not releasably secured by such first open side 100*a* and such second side 100*b*. Instead, and as shown, it is preferable that the component package 202 as received in the recess 100 of FIG. 19 be releasably secured by one or more securing devices such as the aforementioned latch 216 and latch catch 218 securing devices.

As is to be expected, the jack 200 is to be mounted to an underlying substrate 222 (shown in FIG. 17) such that signals pass through the jack 200 between the first contacts 212 and second contacts 224 that are coupled to the substrate 222. In one embodiment of the present invention, and as shown in FIG. 17, the jack 200 has a plurality of the second contacts 224 mounted to the rear portion 210 of the insert 72 for electrically contacting the underlying substrate. Preferably, and as seen, each second contact 224 extends from the rear portion 210 of the insert 72 to the recess 100 and terminates at a termination 228 in communication with the recess 100. Likewise, it is seen that in the present invention, the component package 202 has a plurality of second conductive elements 226 mounted on the exterior surface 204 of such package 202, where the electrical device 203 within the component package 202 is electrically coupled to the second conductive elements 226. Accordingly, the termination 228 of each second contact 224 securely electrically contacts a corresponding second conductive element 226 on the exterior surface 204 of the component package 202 as received in the recess 100.

In one embodiment of the present invention, and as seen in FIGS. 17–19, the first and second conductive elements 206, 226 are located on generally opposing faces of the package 202. However, the elements 206, 226 may also be located elsewhere without departing from the spirit and scope of the present invention.

In one embodiment of the present invention, each termination 228 of the plurality of second contacts 224 is a spring termination. That is, in the same manner as the termination 214 of each first contact 212, the termination 228 of each second contact 224 is also biased in a certain manner and is constructed from a suitable material such that the termination 228 can act as a spring urging toward a particular direction. Again, the direction is toward the recess, whereby the terminations 228 of the plurality of second contacts 224 in combination (and in combination with the terminations 214 of the first contacts 212) releasably secure the component package 202 as received in the recess 100, as is shown in FIG. 17.

Although the second contacts 224 are coupled to the insert 72 of the jack 200 as seen in FIGS. 17 and 19, it may instead be the case that the second contacts 224 are coupled directly to the second conductive elements 226 on the package 202, as seen in FIG. 18. In such a situation, and as should be understood, the second contacts 224 travel with the package 202 and not with the insert 72 of the jack 200.

As seen in FIG. 18, in the case where the package 202 is relatively short, it may be necessary to add a spacer 230 within the recess 100 in order that the package 202 be properly supported and securely held within such recess 100. In one embodiment of the present invention, and as shown, the spacer 230 is a spring spacer, whereby the inserted package 202 biases such spring spacer 230 and such biased spring spacer 230 cooperates with the terminations 214 of the first contacts 212 to secure the package 202 within the recess. Such spring spacer 230 may in any event be necessary where it is desirable to springingly support the package 202 in the area of the second contacts 224, and such springing support is not available from the terminations 228 of the second contacts 224.

Figure 17A:
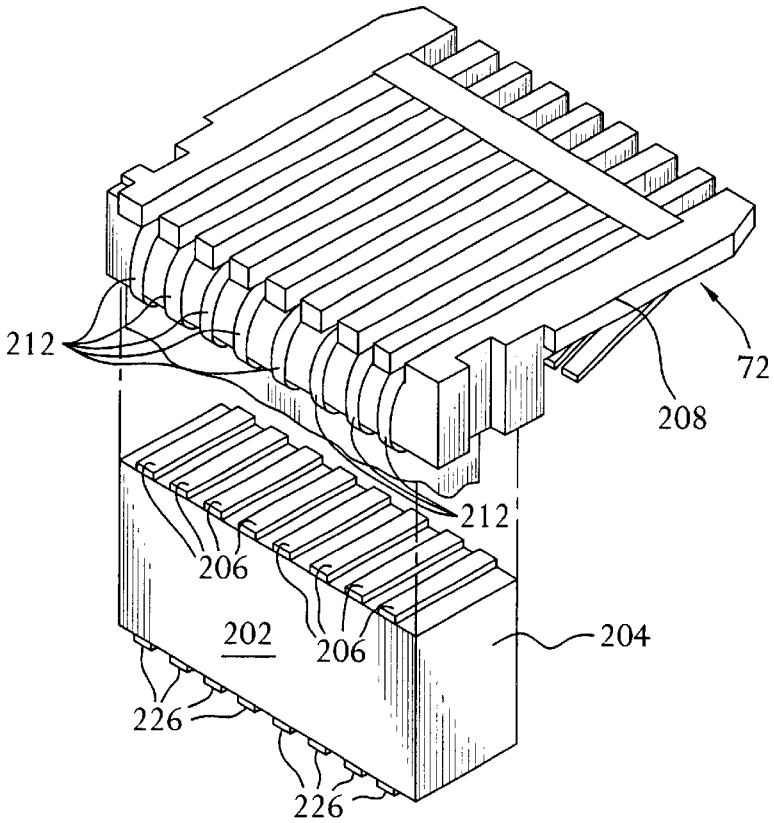
FIG. 17A is an exploded perspective view of a portion of the jack of FIG. 17.

In one embodiment of the present invention, and as best seen in FIG. 17A, the first and/or second conductive elements 206, 226 mounted on the exterior surface 204 of the package 202 comprise conductive pads that are generally coextensive with such exterior surface 204. Here, 'coextensive' means flush with respect to such exterior surface 204, or at least minimally differing in elevation with respect to such exterior surface 204. Accordingly, the package 202 can occupy a relatively large portion of the recess 100 while still making all necessary connections with the first and second contacts 212, 224.

In another embodiment of the present invention, and as best seen in FIGS. 18 and 19, the first and/or second conductive elements 206, 226 mounted on the exterior surface 204 of the package 202 comprise conductive extending elements that extend away from such exterior surface 204. For example, the extending elements may include spring terminations (the first conductive elements 206 as seen in FIG. 18), or may include spring loops (the first and second conductive elements 206, 226 as seen in FIG. 19). In such embodiment, the package 202 can not occupy as large a portion of the recess 100 since accommodating space must be provided in the recess 100 above and below the package 202. However, such spring terminations or spring loops increase the springing contact between the respective contacts 212, 224 and conductive elements 206, 226.

In the present invention, a jack 200 can securely removably receive any of a plurality of electric devices as mounted within a component package 202, and such package 202 may be easily replaced, especially in the field. While the present invention has been described in connection with the embodiments as shown in FIGS. 17–19, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. An electrical connector for receiving a component package having a plurality of first conductive elements and at least one electrical device electrically coupled to the first conductive elements, the electrical connector comprising:

an insulative housing having an interior;

an insulative insert having a forward portion and a rear portion, the rear portion defining a recess for receiving the component package therein, the insert being mounted within the interior of the housing;

a plurality of first contacts mounted to the forward portion of the insert for electrically contacting conductors in a mating connector inserted into the electrical connector, each first contact extending from the forward portion of the insert to the recess and terminating at a termination in communication with the recess, the termination of each first contact for electrically contacting a corresponding first conductive element of the component package as received in the recess, the terminations of the plurality of first contacts in combination for releasably securing the component package as received in the recess wherein said recess at least in part is sandwiched by the respective said terminations.

2. The electrical connector of claim 1 wherein each termination of the plurality of first contacts is a spring termination.

3. The electrical connector of claim 1 wherein the first contacts extend from the forward portion of the insert to the recess generally in a first plane, the first contacts forming a first side of the recess, wherein the recess defines a mouth thereof that generally resides in a second plane generally perpendicular to the first plane, and wherein the rear portion defines a second side of the recess generally opposite the first side, the component package as received in the recess being releasably secured between the first and second sides of the recess after being inserted into the recess through the mouth thereof.

4. The electrical connector of claim 1 wherein the first contacts extend from the forward portion of the insert to the recess generally in a first plane, wherein the recess defines a first open side thereof that generally resides in the first plane, wherein the recess further defines a mouth thereof that generally resides in a second plane generally perpendicular to the first plane, and wherein the rear portion defines a second side of the recess generally opposite the first open side, the component package as received in the recess being releasably secured between the first open side and the second side.

5. The electrical connector of claim 1 wherein such electrical connector is a modular jack.

6. The electrical connector of claim 1 wherein the rear portion of the insert includes a securing device for releasably securing the component package as received in the recess.

7. The electrical connector of claim 6 wherein the securing device includes a pair of opposing latches for cooperating with a corresponding pair of opposing catches on the component package as received in the recess.

8. The electrical connector of claim 1 wherein the component package further has a plurality of second conductive elements, the at least one electrical device of the component package being electrically coupled to the second conductive elements, the electrical connector further comprising a plurality of second contacts mounted to the rear portion of the insert for,electrically contacting an underlying substrate, each second contact extending from the rear portion of the insert to the recess and terminating at a termination in communication with the recess, the termination of each second contact for securely electrically contacting a corresponding second conductive element of the component package as received in the recess.

9. The electrical connector of claim 8 wherein each termination of the plurality of second contacts is a spring termination.

10. The electrical connector of claim 8 wherein the terminations of the plurality of first contacts and of the plurality of second contacts in combination releasably secure the component package as received in the recess.

11. An electrical connector comprising:

a component package having a plurality of first conductive elements and at least one electrical device electrically coupled to the first conductive elements;

an insulative housing having an interior;

an insulative insert having a forward portion and a rear portion, the rear portion defining a recess receiving the component package therein, the insert being mounted within the interior of the housing;

a plurality of first contacts mounted to the forward portion of the insert for electrically contacting conductors in a mating connector inserted into the electrical connector, each first contact extending from the forward portion of the insert to the recess and terminating at a termination in communication with the recess, the termination of each first contact electrically contacting a corresponding first conductive element of the component package as received in the recess, each termination of the plurality of first contacts being a spring termination, the terminations of the plurality of first contacts in combination releasably securing the component package as received in the recess wherein said recess at least in part is sandwiched by the respective said terminations.

12. The electrical connector of claim 11 wherein the terminations of the plurality of first contacts in combination releasably secure the component package as received in the recess.

13. The electrical connector of claim 11 wherein the first contacts extend from the forward portion of the insert to the recess generally in a first plane, the first contacts forming a first side of the recess, wherein the recess defines a mouth thereof that generally resides in a second plane generally perpendicular to the first plane, and wherein the rear portion defines a second side of the recess generally opposite the first side, the component package as received in the recess being releasably secured between the first and second sides of the recess after being inserted into the recess through the mouth thereof.

14. The electrical connector of claim 11 wherein the first contacts extend from the forward portion of the insert to the recess generally in a first plane, wherein the recess defines a first open side thereof that generally resides in the first plane, wherein the recess further defines a mouth thereof that generally resides in a second plane generally perpendicular to the first plane, and wherein the rear portion defines a second side of the recess generally opposite the first open side, the component package as received in the recess being releasably secured between the first open side and the second side.

15. The electrical connector of claim 11 wherein the component package further has a plurality of second contacts for electrically contacting an underlying substrate, the at least one electrical device of the component package being electrically coupled to the second contacts.

16. The electrical connector of claim 11 wherein the plurality of first conductive elements mounted comprise conductive pads generally coextensive with an exterior surface of the component package.

17. The electrical connector of claim 11 wherein the plurality of first conductive elements mounted on the exterior surface comprise conductive contacts extending from an exterior surface of the component package.

18. The electrical connector of claim 11 wherein such electrical connector is a modular jack.

19. The electrical connector of claim 11 wherein the electrical device is a signal conditioning device.

20. The electrical connector of claim 11 wherein the rear portion of the insert includes a securing device releasably securing the component package as received in the recess.

21. The electrical connector of claim 20 wherein the securing device includes a pair of opposing latches cooperating with a corresponding pair of opposing catches on the component package as received in the recess.

22. The electrical connector of claim 11 wherein the component package further has a plurality of second conductive elements, the at least one electrical device of the component package being electrically coupled to the second conductive elements, the electrical connector further comprising a plurality of second contacts mounted to the rear portion of the insert for electrically contacting an underlying substrate, each second contact extending from the rear portion of the insert to the recess and terminating at a termination in communication with the recess, the termination of each second contact securely electrically contacting a corresponding second conductive element of the component package as received in the recess.

23. The electrical connector of claim 22 wherein each termination of the plurality of second contacts is a spring termination.

24. The electrical connector of claim 22 wherein the terminations of the plurality of first contacts and of the plurality of second contacts in combination releasably secure the component package as received in the recess.

25. The electrical connector of claim 22 wherein the plurality of second conductive elements comprise conductive pads generally coextensive with an exterior surface of the component package.

26. The electrical connector of claim 22 wherein the plurality of second conductive elements comprise conductive contacts extending from an exterior surface of the component package.

* * * * *